US005572114A

United States Patent [19]

Ichimaru

[11] Patent Number: 5,572,114

[45] Date of Patent: Nov. 5, 1996

[54] CURRENT MIRROR CIRCUIT WITH BIPOLAR TRANSISTOR CONNECTED IN REVERSE ARRANGEMENT

[75] Inventor: Kouzou Ichimaru, Kunisaki-machi, Japan

[73] Assignee: Texas Instruments Incorporated, Dallas, Tex.

[21] Appl. No.: 228,985

[22] Filed: Apr. 18, 1994

[30] Foreign Application Priority Data

Apr. 16, 1993 [JP] Japan ..... 5-089887

[51] Int. Cl.[6] ..... G05F 3/16; G05F 3/20

[52] U.S. Cl. ..... 323/315; 323/316

[58] Field of Search ..... 323/312, 315, 323/316; 330/257, 288; 327/535, 538, 539, 542

[56] References Cited

U.S. PATENT DOCUMENTS

| | | | |
|---|---|---|---|
| 4,857,864 | 8/1989 | Tanaka | 330/288 |
| 4,937,515 | 6/1990 | Yoshino | 323/315 |
| 5,164,658 | 11/1992 | Kuwahara | 323/315 |
| 5,376,822 | 1/1994 | Taguchi | 257/574 |
| 5,394,079 | 2/1995 | Llewellyn | 323/315 |

*Primary Examiner*—Matthew V. Nguyen

*Attorney, Agent, or Firm*—William E. Hiller; Richard L. Donaldson

[57] ABSTRACT

A semiconductor integrated circuit for performing a current mirror function and capable of operating stably at a low supply voltage to yield an output current nearly equal to the reference current. The current mirror circuit includes a pair of horizontal type pnp transistors and a vertical type npn transistor having an area almost equal to that of either of the pair of horizontal transistors, the vertical type npn transistor being used as a reverse transistor. A current source supplies the base current of the horizontal transistors as well as the collector current of the vertical transistor. Because of its structure, it is possible for the vertical transistor to have a base area and static forward current transfer ratio greater than those of the horizontal transistors. Since the emitter area of the vertical transistor is large, even when it is used to function as a reverse transistor, its static forward current transfer ratio is high. Through using this vertical transistor as a reverse transistor, the effect of the base current of the horizontal transistors on the reference current is reduced.

4 Claims, 2 Drawing Sheets

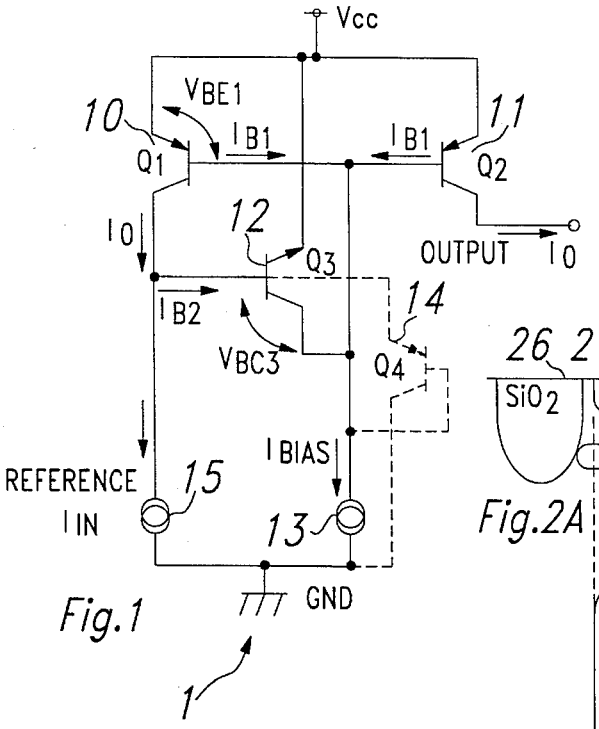
Fig.1
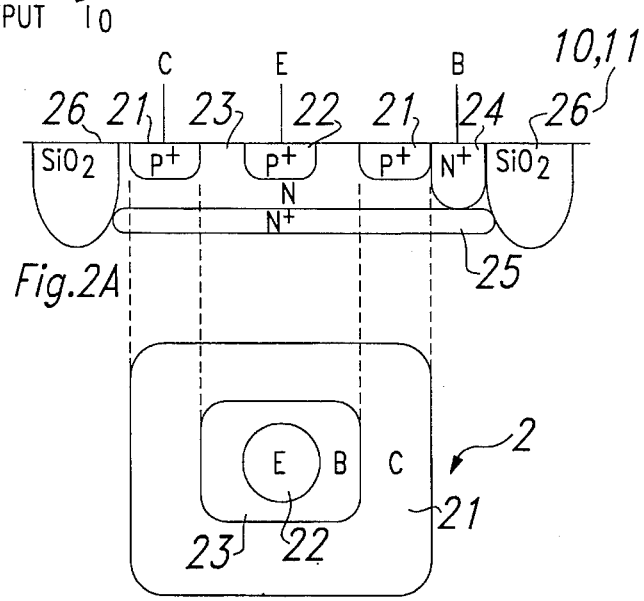
Fig.2A
Fig.2B
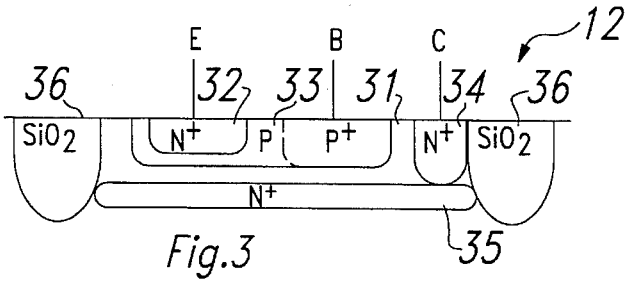
Fig.3
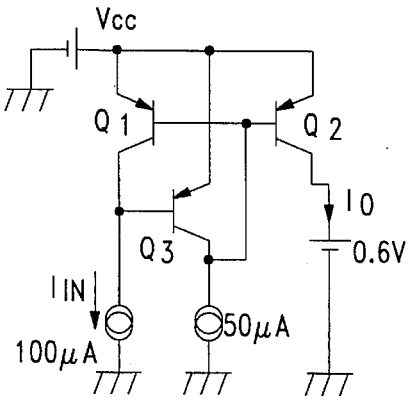
Fig.4B
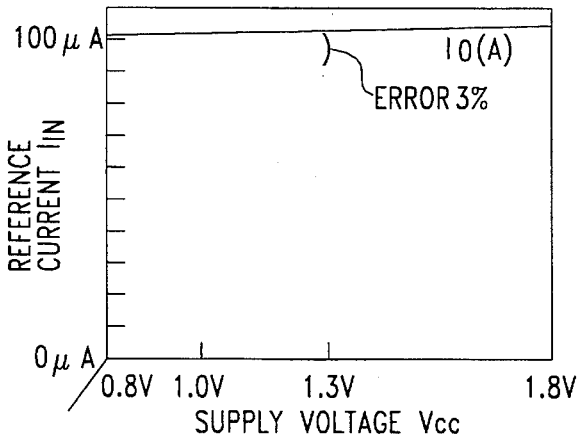
Fig.4A

CURRENT MIRROR CIRCUIT WITH BIPOLAR TRANSISTOR CONNECTED IN REVERSE ARRANGEMENT

The present invention relates to a semiconductor integrated circuit that operates at low voltage and yet is able to perform a highly accurate current mirror function.

BACKGROUND OF THE INVENTION

In a semiconductor integrated circuit, one example of a conventional current mirror circuit is shown in FIG. 6 which illustrates a circuit diagram of a conventional current mirror circuit 5.

The current mirror circuit 5 comprises a horizontal type pnp transistor Q'1 51 and a horizontal pnp transistor Q'2 52, having the same characteristics as those of the transistor 51, and is connected as shown in FIG. 6. 55 represents a current source.

In the current mirror circuit 5, for the currents shown in FIG. 6, the following equations apply.

$$I_{in}=I_o+2I_B \quad (1)$$

$$I_B=I_o/H_{FE} \quad (2)$$

where $I_{in}$ is the reference current;

$I_o$ is the output current;

$I_B$ is the base current of transistors 51, 52; and $H_{FE}$ is the static forward current transfer ratio of transistors 51, 52.

With equations (1) and (2), the relationship shown by the following equation is established between the reference current $I_{in}$ and the output current $I_o$.

$$I_o=I_{in}\cdot H_{FE}/(H_{FE}+2) \quad (3)$$

From equation (3), when the static forward current transfer ratio, $H_{FE}$, of the transistors 51, 52 is sufficiently large, the following equation holds. Therefore, the values of the reference current $I_{in}$ and output current $I_o$ become almost equal.

$$H_{FE}/(H_{FE}+2)\approx 1 \quad (4)$$

A second conventional example of a current mirror circuit is shown in FIG. 7 which is a circuit diagram of a conventional current mirror circuit 6.

The current mirror circuit 6 comprises horizontal type pnp transistors Q'1–Q'3 51-53, with the same characteristics, and they are connected as shown in FIG. 7. 56 is a current source.

For the currents shown in FIG. 7, the following equations hold.

$$I_{in}=I_o+I_{B2} \quad (5)$$

$$I_{B1}=I_o/H_{FE} \quad (6)$$

$$H_{B2}=2I_{B1}/H_{FE} \quad (7)$$

Where $I_{in}$ is the reference current;

$I_o$ is the output current;

$I_{B1}$ is the base current of the transistors 51, 52;

$I_{B2}$ is the base current of the transistor 53; and $H_{FE}$ is the static forward current transfer ratio of the transistors 51, 52.

With the foregoing equations (5–7), the following relationship is established between the reference current $I_{in}$ and output current $I_o$ of the current mirror circuit 6.

$$I_o=I_{in}\cdot H_{FE}^2/(H_{FE}^2+2) \quad (8)$$

From equation (8) , when $H_{FE}$ is sufficiently large, the following equation holds. Accordingly, the values of the reference current $I_{in}$ and output current $I_o$ become almost equal.

$$H_{FE}^2/(H_{FE}^2+2)\approx 1 \quad (9)$$

Since equation (9) is preferable to equation (4) for the convergence condition, when the circuits are formed from the transistors with the same static forward current transfer ratios $H_{FE}$, the output current $I_o$ of the current mirror circuit 6 becomes closer to the reference current $I_{in}$ (greater precision), as compared to the output current $I_o$ of the current mirror circuit 5.

However, as the pnp transistor of a semiconductor integrated circuit, horizontal type transistors are used in most cases as mentioned above.

This horizontal type pnp transistor has the disadvantage that the static forward current transfer ratio $H_{FE}$ is noticeably lowered (to 10 or lower) when high current flows through the transistor.

In other words, there exists the problem that in the circuit shown in the first conventional example, when the current supplied to the transistor becomes high, the static forward current transfer ratio of the transistor is lowered ($H_{FE}<10$), and as is apparent from the equation (3), the output current becomes lower than the reference current by 10% to 20%.

The circuit shown in the second conventional example is that which sets the output current to the reference current even when the static forward current transfer ratio of the transistor is low, and, with this circuit, it is possible to obtain a highly precise output current relative to the reference current.

However, in this case, two transistors are connected in series between power source Vcc and power ground GND, thus causing the problem of requiring the supply voltage to be at least twice the voltage between the base and emitter (normally, about 0.6 V) of the transistor.

This is a serious problem, for example, for the semiconductor integrated circuit that is required to operate by using one nickel/cadmium battery (1.2 V) as a power source.

This means that when this current mirror circuit is used with a voltage of about 1.2 V, there occurs the problem that the operation becomes unstable because of the lack of allowance in supply voltage, or the operation stops when the supply voltage is lowered even slightly.

Considering these problems of prior art current mirror circuits, it is an object of the present invention to provide a semiconductor integrated circuit that can operate stably with a low supply voltage, is capable of yielding an output current nearly equal to the reference current, and can be formed without increasing the processing steps in its manufacturing process.

SUMMARY OF THE INVENTION

The present invention is directed to a semiconductor integrated circuit which is a current mirror circuit provided with first and second transistors of the same conductivity type whose power supply connection terminals and control terminals are commonly connected; and which further includes a third transistor that has the opposite conductivity to that of said first and second transistors, and its control terminal is connected to the output terminal of the first transistor, while its power supply connection terminal is connected to the power supply connection terminals of the first transistor and second transistor, and its output terminal is connected to the control terminals of the first and second transistors.

Also, with respect to this circuit mirror circuit, the first and second transistors are pnp-type transistors, and the third transistor is an npn-type transistor.

Furthermore, the first transistor and second transistor may be of horizontal type in structure, and the third transistor may be of vertical type in structure.

By employing a vertical type npn transistor as the third transistor, and providing a reversed connection of the collector and emitter (as a transistor connected in reverse), and, with this vertical type npn transistor, the base current and reference current of the two horizontal type pnp transistors are separated, thereby reducing the effect of the previously mentioned base current on the reference current.

Also, by making the emitter area of the vertical type npn transistor relatively large, the static reverse current transfer ratio is increased and the effect of separating the reference current from said base current is enhanced. At the same time, the voltage between the base and collector of the vertical type npn transistor is kept lower than the voltage between the base and emitter of the horizontal type pnp transistors, thereby securing the working voltage of the vertical type pnp transistor.

BRIEF DESCRIPTION OF THE DRAWINGS

FIG. 1 is a circuit diagram of a current mirror circuit in accordance with the invention.

FIG. 2A is a cross-sectional view of a horizontal type pnp transistor.

FIG. 2B is a plan view of the horizontal type pnp transistor shown in FIG. 2A.

FIG. 3 is a cross-sectional view of a vertical type npn transistor.

FIG. 4A is a graph showing the simulation results for a current mirror circuit constructed in accordance with the invention.

FIG. 4B is a circuit diagram of a simulated current mirror circuit corresponding to the current mirror circuit shown in FIG. 1 from which the simulation results as provided in the graph shown in FIG. 4A are derived.

Figure 5A:
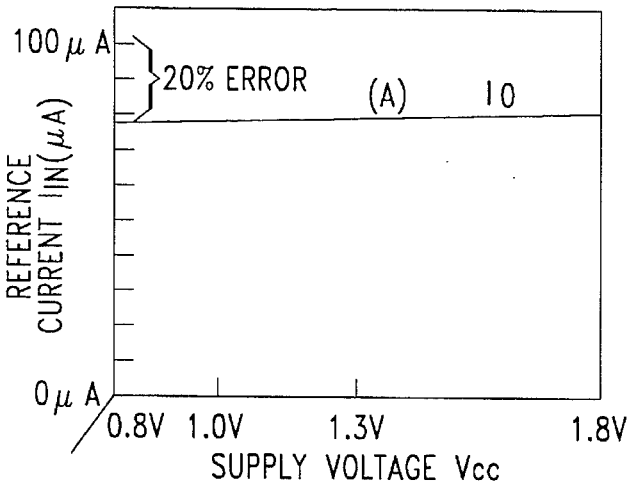
Fig.5A PRIOR ART
FIG. 5A is a graph showing the simulation results for a conventional current mirror circuit.
Figure 5B:
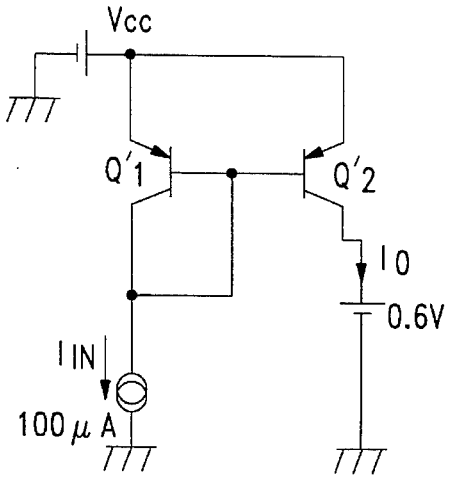
Fig.5B PRIOR ART
FIG. 5B is a circuit diagram of a conventional current mirror circuit as a simulated circuit from which the simulation results shown in the graph of FIG. 5A are derived.
Figure 6:
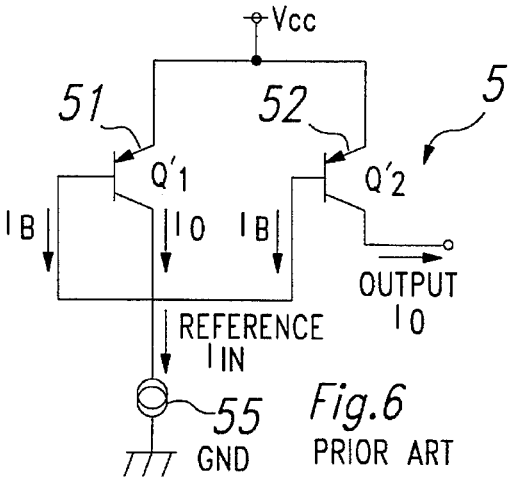
Fig.6 PRIOR ART
FIG. 6 is a circuit diagram of the conventional current mirror circuit on which the data used for the graph of FIG. 5 is based.
Figure 7:
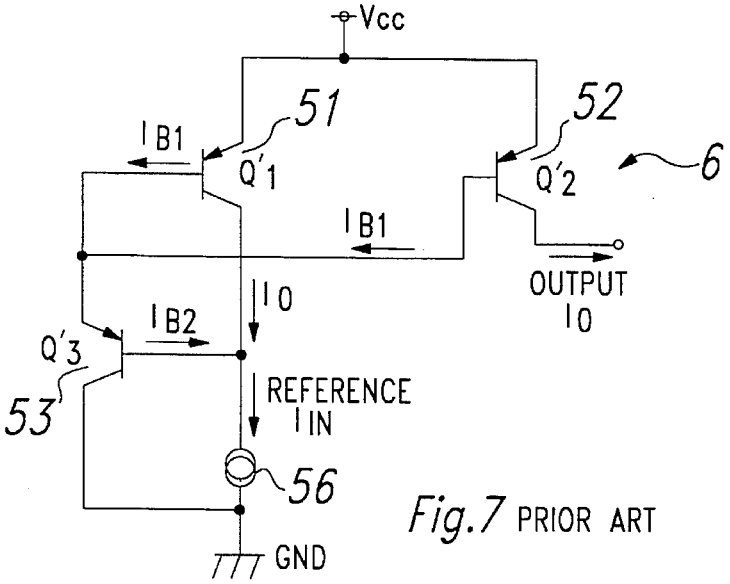
Fig.7 PRIOR ART
FIG. 7 is a circuit diagram of another conventional current mirror circuit.

Reference numerals as shown in the drawings

1 . . . Current mirror circuit
10, 11 . . . Horizontal type pnp transistor
21, 22 . . . $p^+$region
23 . . . n–region
24, 25 . . . $n^+$region
26 . . . $SiO_2$ region
12 . . . Vertical type npn transistor
31 . . . n–region
32, 34, 35 . . . $n^+$region
33 . . . p–region
36 . . . $SiO_2$ region
13 . . . Current source
14 . . . Parasitic transistor
15 . . . Current source

DESCRIPTION OF PREFERRED EMBODIMENT

FIG. 1 is a circuit diagram of a current mirror circuit 1 in accordance with the present invention.

In FIG. 1, the first transistor Q1, 10, is a horizontal pnp transistor.

The second transistor Q2, 11, is a horizontal type pnp transistor having the same characteristics as transistor 10.

In this case, when the collector-emitter voltage is 0.1 V or higher, the transistors 10, 11 operate without saturating.

Also, if necessary, transistors with different characteristics may be used for transistor 10 and transistor 11.

The third transistor Q3, 12, is a vertical type npn transistor formed to have an area almost equal to that of either of the transistors 10, 11.

Since the transistor 12 is nearly equal in area to the area of one of the horizontal type transistors 10, 11, because of its structure, its base-collector junction area is larger than the respective base-emitter junction areas of the horizontal type transistors.

Accordingly, the collector-base voltage of the transistor 12 is lower than the base-emitter voltage of the transistor 10.

The current source 13 supplies the base current of the transistors 10, 11 and the collector current of the transistor 12.

Respective portions of the current mirror circuit 1 are connected as shown in FIG. 1, and the transistor 12 is used in a state where its emitter and collector are connected in a form opposite to their normal way of connection (as a reversed transistor).

In FIG. 1, the arrows indicate current flow in a given branch.

FIG. 2A is a cross-sectional view of either one of the transistors 10, 11.

FIG. 2B is a plan view of the either one of the transistors 10, 11.

The transistors 10, 11 have the same structure as that of a horizontal type pnp transistor used generally in a semiconductor integrated circuit formed on a n-type substrate.

In FIG. 2A, the first $p^+$region 21 is a low resistance p-type silicon area, and it serves as the collector of the transistors 10, 11.

Also, as shown in FIG. 2B, the $p^+$region 21 is formed to surround the periphery of the second $p^+$region 22.

The second $p^+$region 22 is a low resistance p-type silicon area, and it serves as the emitter of the transistors 10, 11.

The n–region 23 is a n-type silicon area, and it functions as the base of the transistors 10, 11.

The first $n^+$region 24 is a low resistance n-type silicon area formed for mounting the base electrode.

The second $n^+$region 25 is an embedded diffusion $n^+$region.

The $SiO_2$ area 26 is an insulation region formed for the separation of the transistors 10, 11.

The transistors 10, 11 have the structure as described above, and their base area is smaller in comparison with the vertical transistor of the same area. Therefore, it is impossible to reduce the collector-base voltage.

FIG. 3 is a diagram showing the structure of the transistor 12.

The transistor 12 has the same structure as that of a vertical type npn transistor used generally in a semiconductor integrated circuit formed on a n-type substrate.

The n–region 31 is a n-type silicon area, and it serves as the collector of the transistor 12.

The first $n^+$region 32 is a low resistance n-type silicon area, and it functions as the emitter of the transistor 12.

The p–region 33 is a p-type silicon region, and it is used as the base of the transistor 12.

Also, the p–region 33 has a low resistance p-type silicon area in a part of it, and in this portion, the base electrode is arranged.

The second $n^+$region 34 is a low resistance n-type silicon area formed for installing the collector electrode.

The second $n^+$region 35 is an embedded diffusion n–region.

The $SiO_2$ area 36 is an insulation region formed for the electrical isolation of the transistor 12 from adjacent electrical components.

The transistor 12 has the structure as mentioned above, and its base-collector junction area is larger in comparison with a horizontal type transistor of the same area. Thus, when it is operated as an inverted transistor, the base-emitter voltage $V_{BE}$, can be reduced.

Also, even when the transistor 12 employs a reversed connection of the collector and emitter (as a reverse transistor), because the emitter area is large, a high current transfer ratio (reverse $H_{FE} \geqq$about 30) can be obtained.

As indicated by the dotted lines in FIG. 1, a parasitic transistor Q4, 14 is formed for the transistor 12.

In order to keep this parasitic transistor 14 from operating, it is preferable to provide a low resistance $n^+$type silicon region around the base, that is, around the p-area 33, of the transistor 12.

In the current mirror circuit 1 shown in FIG. 1, the condition for operating the transistor 10 without saturation is given by the following expression.

$$V_{BE1}-V_{BC3}>0.1 \tag{10}$$

Where $V_{BE1}$ is the voltage between the base and emitter of the transistor 10, and $V_{BC3}$ is the voltage between the base and collector of the transistor 12.

In this case, the voltage $V_{BC3}$ is lower than the voltage $V_{BE1}$, and the current mirror circuit is operable with the supply voltage Vcc above the following.

$$Vcc>V_{BE1} \tag{11}$$

As will be mentioned later, the current mirror circuit 1 operates with a supply voltage of 0.9 V. Thus, it can operate at the low supply voltage at which the current mirror circuit 6 described as the second conventional example cannot operate.

At the supply voltage meeting the condition of the expression 10, the following relations are established between respective currents of the current mirror circuit 1.

$$I_{in}=I_o-I_{B2} \tag{12}$$

$$I_{B2}=(I_{BIAS}-2I_{B1})/H_{FE2} \tag{13}$$

$$H_{FE1}=I_o/I_{B1} \tag{14}$$

Where $I_{in}$ is the reference current;

$I_o$ is the output current;

$I_{B1}$ is the base current of the transistors 10, 11;

$I_{B2}$ is the base current of the transistor 12;

$I_{BIAS}$ is the current of the current source 13;

$H_{FE2}$ is the static forward current transfer ratio of the transistors 10, 11; and $H_{FE1}$ is the static forward current transfer ratio of the transistor 12.

With the aforementioned equations (12–14), the relationship between the reference current $I_{in}$ and output current $I_o$ as shown in the following equation, is obtained.

$$I_o=(I_{in}+I_{BIAS}/H_{FE2})/(1+2/(H_{FE1}\cdot H_{FE2})) \tag{15}$$

In this case, for example, by setting $H_{FE1}=10$, $H_{FE2}=30$, the current of current source 13 $I_{BIAS}=50\mu A$ ($=I_{in}/2$), and reference current $I_{in}=100\mu A$, and substituting into equation 15, $$I_o \approx 1.01 \cdot I_{in} \tag{16}$$

is obtained. As a result, the difference between the output current and reference current is about 1%.

As has been described above, by the use of the current mirror circuit 1, an output current of greater precision as compared with the current mirror 5 described above as the first conventional example can be obtained.

Also, because the vertical type transistor 12 can be formed simultaneously with the horizontal type transistors 10, 11, it is not necessary to increase the number of processing steps during device manufacturing.

A description of the results of a simulation conducted for the current mirror circuit 1 of the present invention and the conventional current mirror circuit 5 is provided below.

FIG. 4A shows the results of the simulation of the current mirror circuit 1 according to the present invention.

FIG. 5A shows the results of the simulation conducted for the current mirror circuit 5 as the first conventional example.

In FIG. 4A, the line indicated by A shows the output current of the current mirror circuit 1.

The error between the reference current and output current of the current mirror circuit 1 is about +1% to +5%. Thus, it is possible to obtain an output current nearly equal to the reference current.

In this case, in the actual circuit, there is a variation in the collector-emitter voltage of each transistor, and the collector-emitter voltage $V_{CE}$ of the transistor 10 is approximately 0.1 V. Also, the transistor's static forward current transfer ratio is dependent on the collector-to-emitter voltage (Early effect). Therefore, logically, equation (15) holds, but, when the foregoing items are taken into consideration, the simulation of such a case is as shown in FIG. 4A.

Since the simulation assumes room temperature (25° C.), it is demonstrated that operation can take place even at 0.8 V of supply voltage. However, when the temperature drops, since the voltage between the base and emitter of the transistor increases, in the actual device (product), a supply voltage of about 0.9 V becomes necessary. The base-emitter voltage of the transistor at −10° C. is higher by about 0.1 V than in the case for 25° C.

On the other hand, the line indicated by A in FIG. 5A shows the output current of the current mirror circuit 5.

In this case, an error between the output current and reference current of about −20% results.

The conditions for the simulation shown in FIG. 5A are the same as those for the current mirror circuit 1, except for transistor Q3, 12, and current source 13.

In addition to the configurations of the embodiment mentioned above, the semiconductor integrated circuit according to the present invention may take on other types of configurations.

According to the present invention, it is possible to make the current mirror circuit operate stably at a low supply voltage.

Also, in contrast to the case of the conventional current mirror circuit used at a low voltage, it is possible to obtain an output current nearly equal to the reference current by use of the current mirror circuit of the present invention.

Furthermore, the current mirror circuit provided by the present invention can be manufactured with the same processes as are used for the conventional current mirror circuit, without requiring additional processing steps for the vertical type transistor.

The semiconductor integrated circuit according to the present invention is particularly useful when used, for example, as the current mirror circuit of an ECL circuit that operates at high speeds and low supply voltages.

I claim:

1. A current mirror circuit comprising:

a first transistor of one conductivity type having a power supply terminal, an output terminal and a control terminal;

a second transistor of the same one conductivity type as said first transistor and having a power supply terminal, an output terminal and a control terminal;

the power supply terminals and the control terminals of said first and second transistors being respectively commonly connected to each other;

a third transistor of opposite conductivity type to said one conductivity type of said first and second transistors and having a power supply terminal, an output terminal and a control terminal;

a first current source having an input and an output, the input of said first current source being connected to the output terminal of said first transistor; and a second current source having an input and an output, the input of said second current source being connected to the output terminal of said third transistor and to a node located in the connection between the control terminals of said first and second transistors;

said third transistor being a bipolar transistor having base, collector and emitter electrodes connected in reverse arrangement with the emitter of said third transistor being the power supply terminal and the collector being the output terminal connected to the input of said second current source; and said second current source drawing a bias current through said third transistor and from the control terminals of said first and second transistors to render said first and second transistors conductive.

2. A current mirror circuit as set forth in claim 1, wherein said first and second transistors of the same one conductivity type are respective first and second bipolar transistors having base, collector and emitter electrodes with the bases and emitters being connected in common.

3. A current mirror circuit as set forth in claim 2, wherein said first and second transistors are PNP transistors, and said third transistor is an NPN transistor.

4. A current mirror circuit as set forth in claim 3, wherein said first and second transistors are lateral PNP transistors of at least substantially identical structure and area and having at least substantially the same operating characteristics; and said third transistor is a vertical NPN transistor having a total area approximately equal to that of one of said lateral PNP transistors and including a base-collector junction area larger than the respective base-emitter junction areas of said lateral PNP transistors; whereby the base-emitter voltage of said vertical NPN transistor is reducible without adversely affecting the operation of the current mirror circuit.

* * * * *